US008689980B2

(12) United States Patent
Rem et al.

(10) Patent No.: US 8,689,980 B2
(45) Date of Patent: Apr. 8, 2014

(54) METHOD AND DEVICE FOR THE SEPARATION OF PARTICLES

(75) Inventors: Peter Carlo Rem, Rijswijk (NL); Laurens Anton Van Kooy, Voorburg (NL)

(73) Assignee: Technische Universiteit Delft (NL)

( * ) Notice: Subject to any disclaimer, the term of this patent is extended or adjusted under 35 U.S.C. 154(b) by 133 days.

(21) Appl. No.: 12/861,605

(22) Filed: Aug. 23, 2010

(65) Prior Publication Data

US 2010/0314298 A1 Dec. 16, 2010

Related U.S. Application Data

(63) Continuation of application No. 10/549,493, filed as application No. PCT/NL2004/000186 on Mar. 16, 2004, now abandoned.

(30) Foreign Application Priority Data

Mar. 17, 2003 (NL) ..... 1022953
Nov. 20, 2003 (NL) ..... 1024818

(51) Int. Cl.
*B03B 5/62* (2006.01)

(52) U.S. Cl.
USPC ..... 209/173; 209/18

(58) Field of Classification Search
USPC ..... 209/17, 18, 156, 172, 173, 450, 453
See application file for complete search history.

(56) References Cited

U.S. PATENT DOCUMENTS

| | | | | | |
|---|---|---|---|---|---|
| 413,188 | A | * | 10/1889 | Kilgour | 209/444 |
| 2,854,136 | A | | 9/1958 | Gillie et al. | |
| 2,960,227 | A | * | 11/1960 | Eder | 209/162 |
| 3,708,063 | A | * | 1/1973 | Morimasa | 209/3 |
| 4,124,497 | A | * | 11/1978 | Hulegard | 209/3 |
| 5,738,222 | A | | 4/1998 | Pagenkopf et al. | |

FOREIGN PATENT DOCUMENTS

| | | | | | |
|---|---|---|---|---|---|
| DE | 1119191 | B | | 12/1961 | |
| JP | 11090408 | A | * | 4/1999 | B09B 5/00 |
| JP | 2008264667 | A | * | 11/2008 | |

* cited by examiner

*Primary Examiner* — Joseph C Rodriguez
(74) *Attorney, Agent, or Firm* — Akerman LLP

(57) ABSTRACT

The invention relates to a method of separating a particle fraction from a particle stream making use of gravitational force and which is performed in a fluid. This provides particle fractions that are collected in respective collecting means. According to the invention the fluid and the collecting means are moved in relation to each other defining a relative direction of movement. There are means provided to limit the movement of the particles to be separated with respect to the fluid in the relative direction of movement. The invention also relates to an apparatus for carrying out the method.

16 Claims, 2 Drawing Sheets

METHOD AND DEVICE FOR THE SEPARATION OF PARTICLES

CROSS-REFERENCE TO RELATED APPLICATION

This application is a continuation of U.S. patent application Ser. No. 10/549,493, filed Sep. 15, 2005, which is a §371 National Phase of PCT/NL 2004/000186, filed Mar. 16, 2004, the entirety of which is incorporated herein by reference.

BACKGROUND

The present invention relates to the use of an apparatus for the separation of particles, which includes a vessel filled with an aqueous solution and provided with baffles radiating from a shaft placed concentrically in the vessel and in the direction of a circumferential wall of the vessel. The vessel is provided with at least two collecting means for the separated particles, which collecting means have their own discharge means, and in use the baffles move so as to impart a movement to the aqueous solution. The invention also relates to a method of separating a particle fraction from a particle stream, wherein the particles of the particle stream are separated in a fluid in a container under the influence of gravitational force based on difference in vertical velocity. The fluid and the particles are moved in a substantially horizontal direction defining a relative direction of movement, and a first particle fraction is collected at a first location, and at a second location somewhat removed from the first location, a second particle fraction is collected in respective collecting means. Means are provided for causing the fluid to move in the relative direction of movement.

Such a method and use of an apparatus are known from the German patent application DE 1 119 191 for the separation of seeds into distinct fractions.

SUMMARY

According to the invention a use of the known apparatus and method is proposed in which bottom ash from a waste incineration plant is introduced into the apparatus, which bottom ash is moved by the aqueous solution in the apparatus in a substantially horizontal direction defining a relative direction of movement for separation of the bottom ash under the influence of gravitational force into a light fraction, and into a heavy fraction comprising more than 90% nonferrous metal. The particle stream is bottom ash from a waste incineration plant and is separated into a light fraction, and into a heavy fraction comprising more than 90% nonferrous metal.

Surprisingly it has been found that such particles, which not only differ from each other with respect to density, but also with respect to size and/or shape, can be effectively separated according to type of material. The term "separation influenced by gravity, based on difference in vertical velocity" used in the present application signifies that an oscillating motion in vertical direction (as known from jigging) is avoided and more generally, turbulence that causes the distribution of particles in the horizontal plane, is avoided. In practice therefore, the time of fall of the particles will be determined by the gravitational force and the interaction with the fluid, and not by other forces exerted on the particles by the apparatus. With respect to the earlier reference to turbulence it is remarked that in the present case, turbulence resulting from the addition of particles to the liquid medium is left out of consideration. In other words, turbulence relates to the turbulence of fluid in the container in absence of the particles.

"Heavy particles" in the present application are understood to be particles that fall through the fluid more quickly than other particles (the light particles). The relative direction of movement is at an angle to the vertical; the first and second collecting means are placed at an angle to the vertical, wherein the orientation of the horizontal component of the relative direction of movement is not perpendicular to the orientation defined by the line between the first and second collecting means.

It is possible to have the fluid stand still while the collecting means are being moved. In such a case the method must be performed such that the particle stream is added in pulses or that the feed moves with the collecting means. The ordinary person skilled in the art requires no explanation regarding the precise dimensions of the parameters, since they can be determined by means of routine experiments. However, in accordance with a preferred embodiment the fluid is transported at right angles to the vertical.

The feed of the particle stream and the collecting means may then remain stationary, which simplifies the technical construction of the apparatus and safeguards the reliability during operation. In addition to that, the turbulence is minimal, which contributes to an optimal separation.

According to the invention, the baffles fulfil two functions, namely moving the fluid and improving the separation.

In this way, an excellent separation can be achieved.

The particles are preferably introduced into a vessel having a substantially circular horizontal cross section, and the fluid moves uniformly around the vessel in the circumferential direction.

In such a case the particles that are introduced into the fluid are preferably radially distributed. In practice an effective separation in the vicinity of the rotation axis will not be efficient so that this part of the vessel is excluded for separation. This may be realised, for example, by the presence of a concentrically placed cylinder in the vessel. It is preferred for this vertically oriented cylinder to co-rotate, and for the baffles to be mounted on the cylinder.

The use of a vessel having a substantially circular horizontal cross section is cheap and it produces little turbulence to disturb the separation.

According to a preferred embodiment, the fluid is a liquid medium.

In a liquid medium the fall resistance is greater, so that the duration of fall is prolonged. This means that in the relative direction the particles are entrained over a greater distance, and this facilitates a better separation.

According to a very advantageous embodiment the liquid medium is an aqueous medium, in particular water.

Water is a cheap, inert and non-toxic liquid medium.

For a further improved separation the particles are subjected to a classification treatment prior to their introduction into the fluid.

In accordance with an important embodiment, the particles are introduced into the liquid medium according to size at various locations in the relative direction of movement, such that the largest particles are the closest to the collecting means.

To particles of the same material and shape applies that the duration of fall still depends on the size of the particle. By classifying the particles, and depending on their size introducing them into the liquid at a different location, their spreading due to particle size may be greatly reduced. When speaking of "being the closest to the collecting means", this refers to the horizontal directional component in the relative direction of movement. It is advantageous to use a drum screen with rectangular slits or bars. This is shown to significantly increase the size range of particles that can still be effectively separated. It is also advantageous to perform a separation using air as fluid before performing the separation using a liquid.

Although the method according to the invention can be carried out in batches, continuous operation is preferred. According to a preferred embodiment, the first relatively heavy and the second relatively light particle fractions are at the underside of the container separately discharged via a respective discharge opening of the container.

In order to effectively remove the particles that have landed on the floor of the container it is preferred to use a Net stream. As it is generally difficult to remove wire-shaped materials by means of jet streams, it is preferred to remove such wire-shaped materials from the particle stream prior to the separation with the fluid.

The invention also relates to the use of an apparatus for separating particles from a particle stream consisting of bottom ash from a waste incineration plant, which apparatus comprises a vessel provided with baffles that extend radially from a shaft placed vertically in the centre of the vessel, toward the circumferential wall of the vessel, and wherein the vessel is provided at its underside with at least two collecting means having their own discharge means.

Preferably there are means provided for driving the baffles, which in that case are able to carry along a liquid medium introduced into the vessel.

There are preferably at least 10 baffles, preferably at least 20 and more preferably at least 30 baffles.

It is also preferred for the circumferential wall of the vessel, which when in use is in contact with the fluid, to be designed to rotate at the same number of revolutions as the shaft.

This may be realised simply by attaching the baffles to the circumferential wall. There are various advantages. First, the turbulence is reduced, which contributes to a good separation. Second, no particles can become lodged between the rotating and the stationary circumferential wall, which increases the operational safety.

A further preferred embodiment is obtained if the vertical velocity of the fluid is such that in a container having substantially circular horizontal cross section, the fluid present at the feed level will during one circulation of the fluid have moved at least as far as the collecting means. In this way the particles with very low terminal velocities are also transported to the collecting means and, viewed in the circumferential direction, are collected in substantially a last collecting means. Such a vertical movement of the fluid may be obtained by, for example, in the vicinity of the collecting means or after the discharge therefrom, withdrawing fluid from the discharge stream and, optionally after the removal of impurities, returning this to the feed level where the particle stream to be separated is introduced.

BRIEF DESCRIPTION OF THE DRAWING

The present invention is elucidated by way of the following experiment and with reference to the drawings, in which.

DETAILED DESCRIPTION

Figure 1:
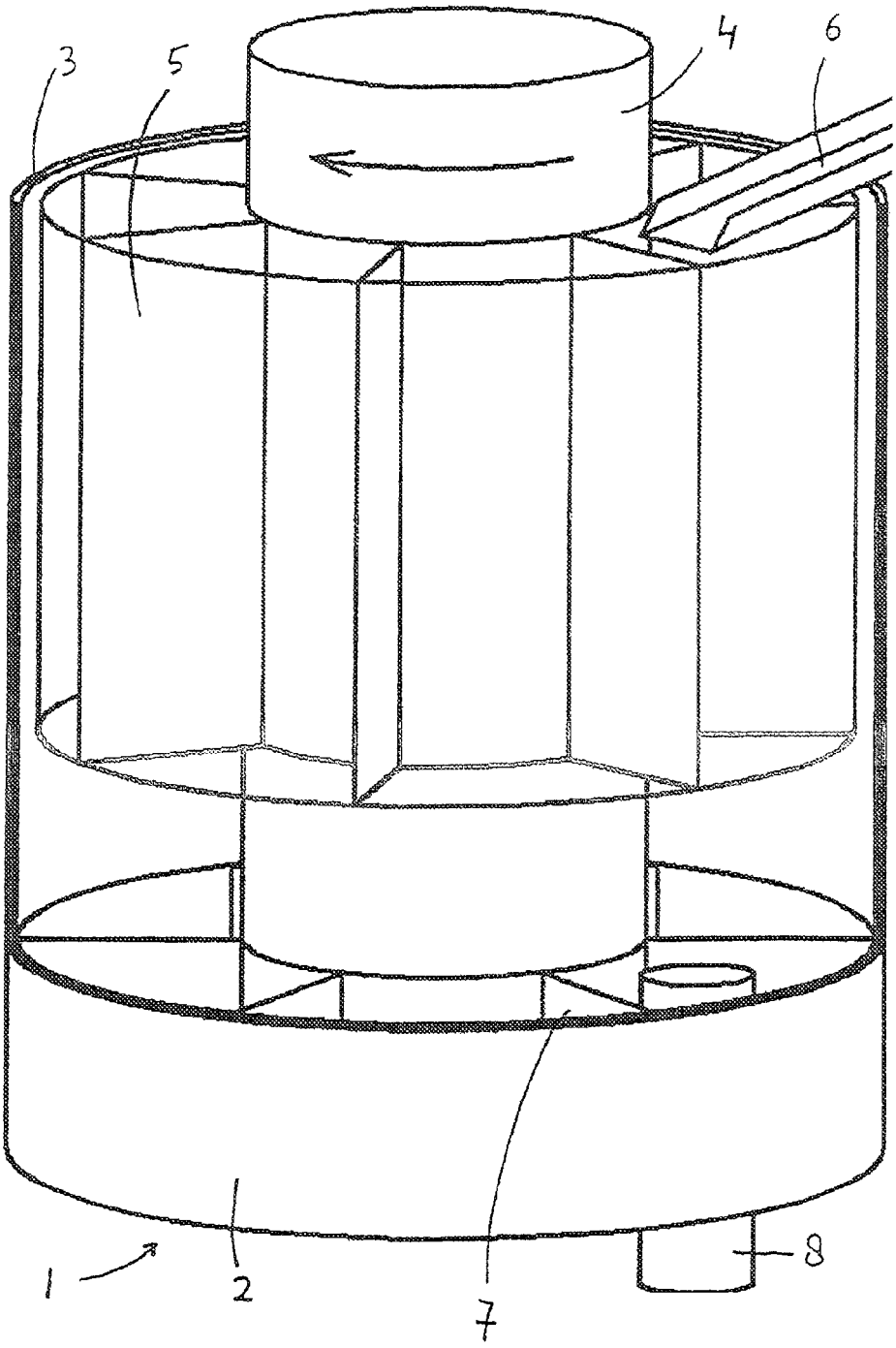
FIG. 1 depicts an apparatus for carrying out the treatment according to the invention.

FIG. 1 shows a partly cut-away drawing of an apparatus 1 suitable for carrying out the method according to the invention. The apparatus comprises a vessel 2 having a wall 3. The vessel 2 is provided with an inner cylinder 4, which is provided with baffles 5 (only a limited number is shown. The apparatus used, having a diameter of 1 meter actually possessed 50 baffles). The inner cylinder 4 is driven by a motor (not shown). Via a feed vessel 6 a particle stream to be treated can be supplied over at least substantially the total distance between the outer wall 3 of the vessel 2 and the inner cylinder 4. There is little turbulence in the liquid medium, such as water, carried along between the baffles 5, and an excellent separation can be achieved. In the bottom of vessel 2 stationary receptacles 7 are provided in which the various fractions are collected. The floor of each receptacle 7 may taper and may comprise a channel that is open at the top and connected to a discharge pipe, via which with the aid of a jet stream from a nozzle, particles that have found their way into the channel are discharged (not shown). Finally, there is a (schematic) illustration of a feed opening 8 that can be used for the feed of a liquid medium containing the particles to be separated that have a lower density than the liquid medium, as may be the case with plastic particles such as polyethylene/polypropylene particle mixtures with water as fluid. In such a case collecting means are provided at the top side of the vessel 2 for the removal of the separated plastic particles.

Figure 2:
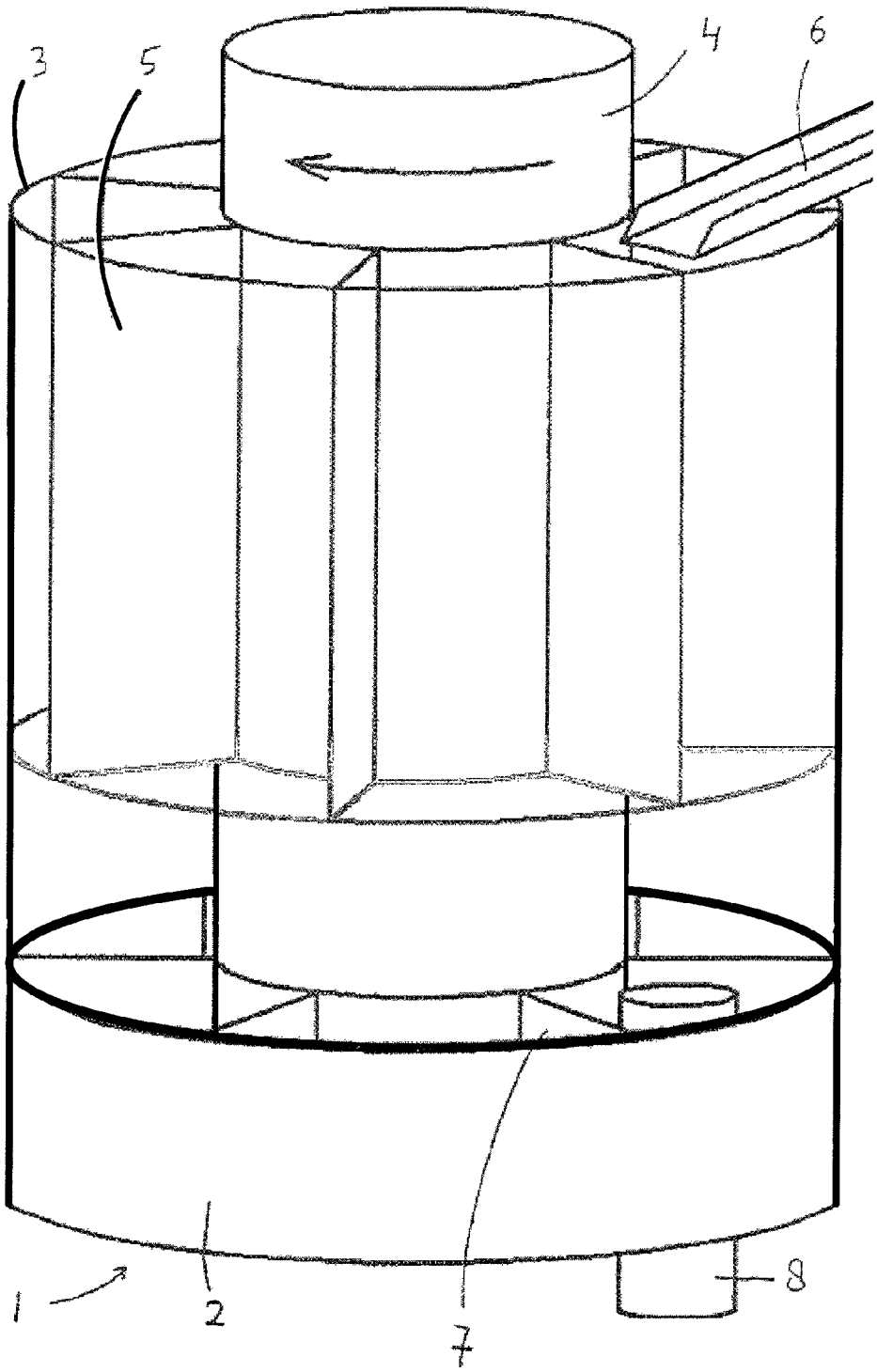
FIG. 2 depicts an alternative embodiment of an apparatus for carrying out the treatment according to the invention.

FIG. 2 shows the baffles 5 attached directly to the circumferential wall 3. This arrangement allows the circumferential wall to rotate at the same number of revolutions as the shaft.

In the experiment, bottom ash was first sifted, subjected to a first separation (magnetic) and subsequently to a fall separation.

Sifting

In a large-scale experiment bottom ash from a waste incineration plant was sifted wet, wherein as well as a very coarse and a very fine fraction, a fraction of 2-6 mm and a fraction of 50 micron-2 mm were produced.

Magnetic Separation

Prior to the separation according to the velocity of fall in water, the 2-6 mm fraction is first treated with a rotary drum eddy-current separator under the conditions shown in Table 1. The data on the feed and the product streams as estimated from analyses, are presented in Table 2. In this treatment a separator is used having a magnetic rotor with 18 poles (9 north poles and 9 south poles), with the rotor rotating counter to the usual direction at 1000 rotations per minute. Assuming a field change signifies the complete cycle of the magnetic field of the rotor at a fixed point, then the separation is carried out at (9*1000/60=) 150 field changes per second. The field intensity was approximately 0.3 Tesla at the surface of the conveyer belt conveying the material over the magnetic rotor. The material was collected at a level of approximately 66 cm under the shaft of the rotor in three collecting vessels (1: more than 45 cm from the rotor shaft, 2: between 30 and 45 cm from the rotor shaft, and 3: less than 30 cm from the rotor shaft). With the feed approximately 100 kg water were added to the wet-sifted fraction, in order to increase the moisture content to 15%. Considering the particle size of the feed, the number of field changes per second was unusually low. However, two control experiments with small amounts of feed (Table 3) show that the amount of recovered non-ferrous compounds in the concentrate does not significantly increase if the rotor speed is increased to 2000 rpm, while at the higher rotor speed lightly magnetic particles are entrained to the non-ferrous fraction, with possible adverse effects for the non-ferrous products.

Separation in Liquid Medium (Treatment b))

The products 1 and 2 of this first treatment were combined and a portion thereof, i.e. approximately 80 kg, was separated according to velocity of fall in water, by feeding the material over the width of the annular vessel whose sides are formed by an outer cylinder having a 1 m diameter and a concentric inner cylinder having a 0.5 m diameter, both having a vertical (coinciding) axis and being 1.0 meter high, filled with water moving in a homogenous circulating movement and provided at the underside with six equal receptacles, successively arranged in the direction of circulation. The water movement was generated by a rotating impeller of radially extending baffles mounted on the likewise rotating inner cylinder (engine power 2 kW). The baffles were connected with an outer wall that co-rotated in order to limit the turbulence in the water. The speed of rotation was 5 rpm. The heavy non-ferrous fraction was collected in the first receptacle after the feed point, and the light, non-ferrous metal-depleted product was collected in the two succeeding receptacles. Importantly, this wet separation also resulted in the reduction of organic material in the non-ferrous metal-depleted fraction. This means that said material, comprising mainly sand and stone, is less liable to give off metals to the environment as a result of leaching. This makes it better usable as material for road construction and the like. A portion of the organic material was discharged over the rim of the vessel, and some of it found its way into other receptacles at the bottom of the vessel. Table 4 shows the weight of non-metal, aluminium and heavy non-ferrous in the light and heavy product. It can be seen that more than 90% consists of heavy non-ferrous metal, containing little aluminium (which is very favourable with respect to the saleability of the heavy non-ferrous metal). The light fraction contains mainly sand and some non-ferrous, which by means of Magnus separation can be separated in the form of aluminium concentrate. The size fraction between 3.5 and 7 mm was not analysed since it was patently obvious that it contained very little non-ferrous, especially aluminium. Summarising it may be said that in comparison with the known methods, the described apparatus and method facilitate an excellent separation with a large turnover, little wear and low energy consumption.

The fact that a particular measurement was not carried out, usually because the value was deemed to be insignificant, is in the table indicated by '/'.

TABLE 1

Process conditions pre-separation.

| | |
|---|---|
| Rotor speed (rpm) | −1000 |
| Number of poles | 18 |
| Belt velocity (m/s) | 0.94 |
| Belt width (m) | 0.75 |
| Level of splitters | −66 |
| Position splitter 1 | 30 |
| Position splitter 2 | 45 |
| Moisture content | 15 |
| Feed (kg) | 1118 |
| Feed speed (kg/s) | 8.5 |
| Processing time | 20 |

Positions in relation to the shaft of the rotor.

TABLE 2

Feed, added water and products from pre-separation

| | Weight (kg) |
|---|---|
| Feed sifted wet | 1015 |
| Water (added) | 103 |
| Feed dry | 943 |
| Water (total) | 175 |

TABLE 2-continued

Feed, added water and products from pre-separation

| | Weight (kg) |
|---|---|
| Total feed | 1118 |
| Product 1 dry | 28 |
| Product 2 dry | 96 |
| Product 3 dry | 836 |
| Heavy non-ferrous in 3 | Non detectable |
| Aluminium in 3 | 2.5 |

TABLE 3

Results at 1000 rpm (top) and at 2000 rpm (bottom) for products 1, 2, and 3.

| | Al | Zn/Cu | Mag. | Non Mag. | Tot. |
|---|---|---|---|---|---|
| 1 | 21.4 | 17.4 | / | 311.4 | 350.2 |
| 2 | 15 | 25.6 | / | 7671.36 | 7711.96 |
| 3 | 0.5 | / | 5798.05 | 5349.95 | 11148.5 |
| Tot. | 36.9 | 43 | 5798.05 | 13332.71 | 19210.66 |
| 1 | 18.08 | 18.03 | 58.28 | 277.92 | 372.31 |
| 2 | 17.49 | 21.37 | 476.5 | 6448 | 6963.36 |
| 3 | 0.13 | 0.73 | 8036 | 4306 | 12342.86 |
| Tot. | 35.7 | 40.13 | 8570.78 | 11031.92 | 19678.53 |

TABLE 4

Results from the separation according to velocity of fall in water of approximately 80 kg pre-concentrate of 2-6 mm wet sifted bottom ash.

| | Al (g) | Zn/Cu (g) | Stone (g) | Tot. (g) |
|---|---|---|---|---|
| Heavy | | | | |
| +5.6 mm | 133.65 | 3824.81 | 877.57 | 4836.03 |
| −5.6 + 4 mm | 48.033 | 3160.047 | 45.02 | 3253.1 |
| −4 mm | / | 2920 | / | 2920 |
| Tot. | | | | 11009.13 |
| Light | | | | |
| −3.5 mm | 459.108 | 177.741 | 4504.80 | 5.141 |
| −7 + 3.5 mm | | | | 37.38 |
| +7 mm | | | | 22.75 |
| Tot. | | | | 65.271 |

The invention claimed is:

1. A method of separating a particle fraction from a particle stream, comprising the steps of:

providing an apparatus for the separation of particles, which comprises a vessel filled with an aqueous solution and provided with baffles radiating from a shaft placed concentrically in the vessel and connected to a circular wall that co-rotates with the baffles in order to limit the turbulence in the water, and at least two collecting means for the separated particles, which collecting means have their own discharge means;

moving the baffles so as to impart a movement to the aqueous solution; and introducing bottom ash from a waste incineration plant into the apparatus, which bottom ash is moved by the aqueous solution in the apparatus in a substantially horizontal direction defining a relative direction of movement for separation of the bottom ash under the influence of gravitational force into a light fraction, and into a heavy fraction comprising more than 90% nonferrous metal.

2. The method according to claim 1, wherein the light fraction is a nonferrous metal depleted fraction.

3. The method according to claim 1, wherein prior to its introduction into the apparatus, the bottom ash is sifted to a fraction of 2-6 mm.

4. The method according to claim 1, wherein the circular wall of the vessel, which in use is in contact with the fluid, is designed for rotating at the same rotational speed as the shaft.

5. A method of separating a particle fraction from a particle stream, wherein the particles of the particle stream are separated in a fluid in a container under the influence of gravitational force based on difference in vertical velocity, the method comprising the steps of:

moving the fluid and the particles in a substantially horizontal direction defining a relative direction of movement;

collecting a first particle fraction at a first location in a respective collecting means;

collecting, at a second location somewhat removed from the first location, a second particle fraction in respective collecting means; and moving the fluid in the relative direction of movement, wherein the particle stream is bottom ash from a waste incineration plant and is separated into a light fraction, and into a heavy fraction comprising more than 90% nonferrous metal, and wherein the introduction into the fluid occurs in a particle size-dependent manner at different locations along the relative path of movement, such that the larger particles are the closest to the collecting means.

6. The method in accordance with claim 5, wherein the light fraction is a non-ferrous metal depleted fraction.

7. The method according to claim 5, wherein the particles of the bottom ash are introduced into a vessel having a substantially circular horizontal cross section and the fluid is moved uniformly in the circumferential direction in the vessel.

8. The method according to claim 5, wherein a container is used wherein the means for causing the fluid to move are formed by baffles placed in the vessel and radiating from a shaft placed vertically in the centre of the vessel, toward the circumferential wall of the vessel.

9. The method according to claim 5, wherein as fluid a liquid medium is used having a density lower than that of the particles of the bottom ash.

10. The method according to claim 9, wherein the liquid medium is an aqueous medium.

11. The method according to claim 5, wherein prior to their introduction into the fluid, the particles of the bottom ash are subjected to a classification treatment.

12. The method according to claim 5, wherein at the underside of the container the first relatively heavy and the second relatively light particle fractions are discharged separately via a respective discharge opening in the container.

13. The method according to claim 12, wherein the discharge occurs by using a jet stream.

14. The method according to claim 5, wherein the fluid has a vertical velocity such that the fluid originally present at the feed level in a container having a substantially circular horizontal cross section, will during one circulation of the fluid have moved at least as far as the collecting means.

15. An apparatus for the separation of particles, comprising:

a vessel filled with an aqueous solution and provided with baffles radiating from a shaft placed concentrically in the vessel connected to a circular wall that co-rotates with the baffles in order to limit the turbulence in the water;

at least two collecting means for the separated particles, the collecting means being provided in the vessel and having their own discharge means;

means for moving the baffles so as to impart a substantially horizontal movement to the aqueous solution;

means for introducing bottom ash from a waste incineration plant into the apparatus, the bottom ash being moved in use by the movement of the aqueous solution in a substantially horizontal direction, defining a relative direction of movement for separating the bottom ash under the influence of gravitational force into a light fraction, and a heavy fraction comprising more than 90% heavy metal.

16. The apparatus according to claim 15, wherein the circular wall that is connected with the baffles is designed to rotate at the same rotational speed as the shaft.

* * * * *